US008820233B2

(12) United States Patent
Chow et al.

(10) Patent No.: US 8,820,233 B2
(45) Date of Patent: Sep. 2, 2014

(54) ANILOX METERING SYSTEM FOR ELECTROGRAPHIC PRINTING

(75) Inventors: Eugene M. Chow, Fremont, CA (US); Jing Zhou, Webster, NY (US); Gerald A. Domoto, Briarcliff Manor, NY (US); Grace T. Brewington, Fairport, NY (US)

(73) Assignees: Palo Alto Research Center Incorporated, Palo Alto, CA (US); Xerox Corporation, Norwalk, CT (US)

( * ) Notice: Subject to any disclaimer, the term of this patent is extended or adjusted under 35 U.S.C. 154(b) by 512 days.

(21) Appl. No.: 12/566,568

(22) Filed: Sep. 24, 2009

(65) Prior Publication Data

US 2011/0067590 A1 Mar. 24, 2011

(51) Int. Cl.

| | |
|---|---|
| ***B41F 9/10*** | (2006.01) |
| ***B41F 31/04*** | (2006.01) |
| ***B41M 1/42*** | (2006.01) |
| ***G03G 15/10*** | (2006.01) |

(52) U.S. Cl.

CPC ..... *G03G 15/104* (2013.01)

USPC ..... 101/155; 101/157; 101/170; 101/489; 101/350.6

(58) Field of Classification Search

USPC ..... 101/153, 170, 154, 155, 156, 350.1, 101/350.2, 350.5, 350.6, 157, 167, 168, 101/169, 489

See application file for complete search history.

(56) References Cited

U.S. PATENT DOCUMENTS

| | | | | |
|---|---|---|---|---|
| 3,801,315 | A | 4/1974 | Gundlach et al. | |
| 4,043,657 | A * | 8/1977 | Karnik | 399/239 |
| 4,625,643 | A * | 12/1986 | Davis | 101/363 |
| 5,241,351 | A * | 8/1993 | Owens | 399/351 |
| 5,370,052 | A | 12/1994 | Reslow et al. | |
| 5,983,797 | A | 11/1999 | Secor | |
| 6,309,049 | B1 | 10/2001 | Salmon | |
| 6,367,380 | B1 | 4/2002 | Whelan et al. | |
| 6,578,478 | B2 | 6/2003 | Doppler | |
| 8,087,771 | B2 | 1/2012 | Thayer et al. | |
| 8,119,315 | B1 * | 2/2012 | Heuft et al. | 430/58.05 |

(Continued)

OTHER PUBLICATIONS

Lindblad, N.R., "The metering of ink the grooves of a gravure roll", J. Imaging Technology, vol. 14, issue 5, p. 140-143, 1988.

(Continued)

*Primary Examiner* — Leslie J Evanisko

(74) *Attorney, Agent, or Firm* — Blakely Sokoloff Taylor & Zafman LLP

(57) ABSTRACT

A method and apparatus to meter ink for electrographic printing is disclosed. An ink loading mechanism having an anilox roller fills ink from an ink supply into cells in the anilox roller having a plurality of valleys and lands that form the cells. The ink loading mechanism causes the valleys to be full or nearly full with the ink. The anilox roller rotates in a first direction. In one embodiment, a soft blade positioned slightly below surface of the lands removes ink from the cells and causes the valleys to be partially filled as the anilox roller rotates. A hard blade positioned at the surface of the lands to clean residue of ink on the surface of the lands as the anilox roller rotates. In another embodiment, a blanket roller rotationally engaged with the anilox roller pulls ink out of the cells and causes the valleys to be partially filled. The blanket roller rotates in a second direction. A first cleaning blade cleans tops of the lands of the cells.

18 Claims, 11 Drawing Sheets

(56) References Cited

U.S. PATENT DOCUMENTS

| | | | | |
|---|---|---|---|---|
| 2007/0020005 | A1* | 1/2007 | Shigezaki et al. | 399/349 |
| 2008/0017055 | A1 | 1/2008 | Howard | |
| 2009/0304406 | A1* | 12/2009 | Thayer et al. | 399/71 |
| 2011/0067589 | A1 | 3/2011 | Chow et al. | |

OTHER PUBLICATIONS

Coyle, Dennis, "Chapter 3: Roll Coating" Modern Coating and Drying Technology, E. Cohen (editor), p. 63-116, 1992.

* cited by examiner

ANILOX METERING SYSTEM FOR ELECTROGRAPHIC PRINTING

TECHNICAL FIELD

The presently disclosed embodiments are directed to the field of printing technology, and more specifically, to electrostatic printing.

BACKGROUND

Electrostatic printing is a printing technology in which electrostatic forces are used to form the image in powder or ink directly. Usually, ink is metered into an anilox, or gravure, roller such that the cells, or grooves, are partially filled. Ink refers to any material which is to be placed on a final substrate, and may include liquids, powders, and solid. To form an image, the ink is electrostatically pulled out of the cells in an image-wise fashion. Typically, metering rollers are used to meter the amount of ink applied to an anilox roller. An anilox roller includes a cylindrical surface with millions of very fine hollows, shaped as cells or grooves. Anilox and gravure are terms both referring to cylinders with small cells/grooves on the surface and may be used interchangeably. Technically, the term anilox is used more in flexographic printing and gravure is used in gravure printing. The gravure cells may usually be patterned in an image while the anilox cells may not be. Ink to be metered is filled in the cells. Doctor blades or wiping blades are usually used to clean the lands of the anilox roller. In doctor blade mode, doctor blades may be placed in an angle more than 90 degrees with respect to the blade moving direction. In wiping blade mode, wiping blades may be placed in angles less than 90 degrees with respect to the blade moving direction.

Existing technologies for electrostatic printing using anilox rollers have a number of drawbacks. Traditional cleaning using doctor blades may leave the cells full which leads to the problem of high background printing. The blades may be adjusted, but blades have inherent problems, including particle trapping, non-uniformity, speed limitations and cell pattern restrictions. For example, in a single blade system, there is an inherent conflict between the metering and cleaning requirements of the blade, as it needs to be soft enough to go into the cells or grooves, but hard or stiff enough to effectively wipe off residue ink from the lands. Another technique used a wiping blade mode, but this mode works only at slow speeds, as higher speeds increase the hydrodynamic pressure significantly.

SUMMARY

One disclosed feature of the embodiments is a method and apparatus to meter ink for electrographic printing. An ink loading mechanism having an anilox roller fills ink from an ink supply into cells in the anilox roller with a plurality of valleys and lands that form the cells. The ink loading mechanism causes the valleys to be full or nearly full with the ink. The anilox roller rotates in a first direction. A blanket roller rotationally engaged with the anilox roller pulls the ink out of the cells and causes the valleys to be partially filled. The blanket roller rotates in a second direction. A first cleaning blade cleans the tops of the lands of the cells.

One disclosed feature of the embodiments is a method and apparatus to meter ink for electrographic printing. An ink loading mechanism having an anilox roller fills ink from an ink supply into cells in the anilox roller having a plurality of valleys and lands forming the cells. The ink loading mechanism causes the valleys to be full or nearly full with the ink. The anilox roller rotates in a first direction. A soft blade positioned slightly below surface of the lands removes ink from the cells and causes the valleys to be partially filled as the anilox roller rotates. A hard blade positioned at the surface of the lands cleans ink residue on the surface of the lands as the anilox roller rotates.

BRIEF DESCRIPTION OF THE DRAWINGS

Embodiments may best be understood by referring to the following description and accompanying drawings that are used to illustrate various embodiments. In the drawings.

DETAILED DESCRIPTION

Figure 1:
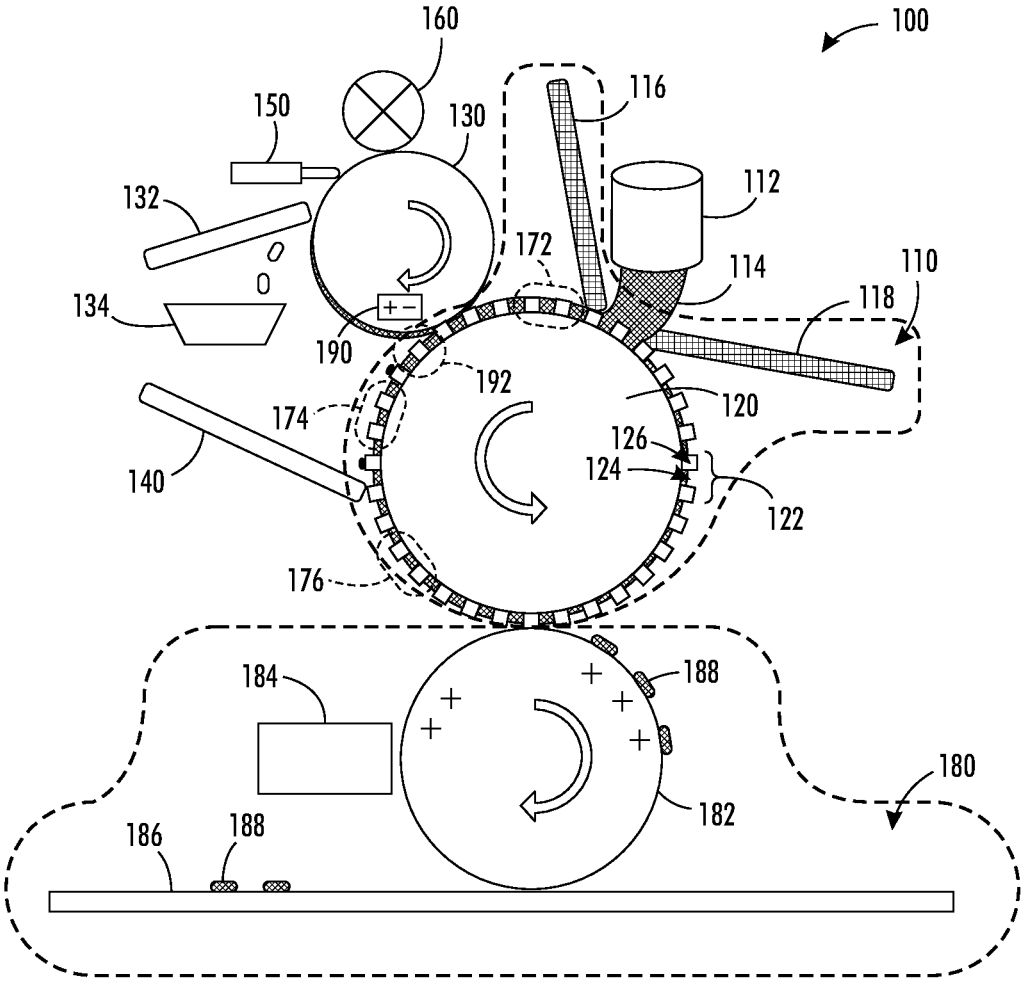
FIG. 1 is a diagram illustrating a system according to one embodiment.

One disclosed feature of the embodiments is a method and apparatus to meter ink for electrographic printing. An ink loading mechanism having an anilox roller fills ink from an ink supply into cells in the anilox roller with a plurality of valleys and lands that form the cells. The ink loading mechanism causes the valleys to be full or nearly full with the ink. The anilox roller rotates in a first direction. A blanket roller rotationally engaged with the anilox roller pulls the ink out of the cells and causes the valleys to be partially filled. The blanket roller rotates in a second direction. A first cleaning blade cleans tops of the lands of the cells.

One disclosed feature of the embodiments is a method and apparatus to meter ink for electrographic printing. An ink loading mechanism having an anilox roller fills ink from an ink supply into cells in the anilox roller having a plurality of valleys and lands forming the cells. The ink loading mechanism causes the valleys to be full or nearly full with the ink. The anilox roller rotates in a first direction. A soft blade positioned slightly below surface of the lands removes ink from the cells and causes the valleys to be partially filled as the anilox roller rotates. A hard blade positioned at the surface of the lands cleans residue of ink on the surface of the lands as the anilox roller rotates.

One disclosed feature of the embodiments may be described as a process which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a program, a procedure, a method of manufacturing or fabrication, etc. One embodiment may be described by a schematic drawing depicting a physical structure. It is understood that the schematic drawing illustrates the basic concept and may not be scaled or depict the structure in exact proportions.

One disclosed feature of the embodiments uses a blanket roller to meter the ink so that the cells in the gravure of the anilox roller are partially filled. Ink is first delivered to the cells using conventional flexography/gravure means, resulting in cells which are full or nearly full. A blanket roller is then used to pull ink out of the cells, leaving the cells partially filled. Pressure, speed ratio, surface energy coating, and electric field may be used to control the amount of ink pulled out of the cells. Reverse or forward roll metering may be used. A cleaning system may be used to clean the ink off the blanket roller and recycle it into the original ink supply. An optional cleaning blade may be used to clean the top of the lands of any residue ink. The cleaning blade may be a standard blade.

One main advantage of filling the ink partially full is that electrostatic forces may be used to pull or withdraw ink out of the partially full cells during the image printing phase. Such a printing process may print viscous ink, such as flexographic ink, digitally while the pixels of the image may be addressed with the charge image generation systems used in standard laser printers. The system may print inks with higher pigment and binder concentrations than inks printed by inkjet, providing advantages such as larger substrate latitude, higher optical densities, and more robust inks. These inks use only heat, drying, or ultraviolet light to fix to the substrate as they do not require high pressure or temperature fusers found in toner systems. Other advantages may include higher speed and more robust metering and less mechanical precision required to tune the metering.

FIG. 1 is a diagram illustrating a system 100 according to one embodiment. The system 100 may be part of an electrographic printing system and includes an ink loading unit or mechanism 110, a blanket roller 130, a cleaning blade 140, a blanket roller cleaner 150, a speed controller 160, an image forming unit 180, and an electric field generator 190. Note that the system 100 may include more or less than the above components. Some of the components may be optional.

The ink loading unit or mechanism 110 and the blanket roller 130 form a metering unit in the electrographic printing system. The ink loading mechanism 110 may be a conventional ink loading mechanism. It may include an anilox roller 120, a doctor blade 116 and a containment blade 118. The combined components of the doctor blade 116, the ink supply 112, and the containment blade 118 may be referred to as a chamber blade system.

Figure 6:
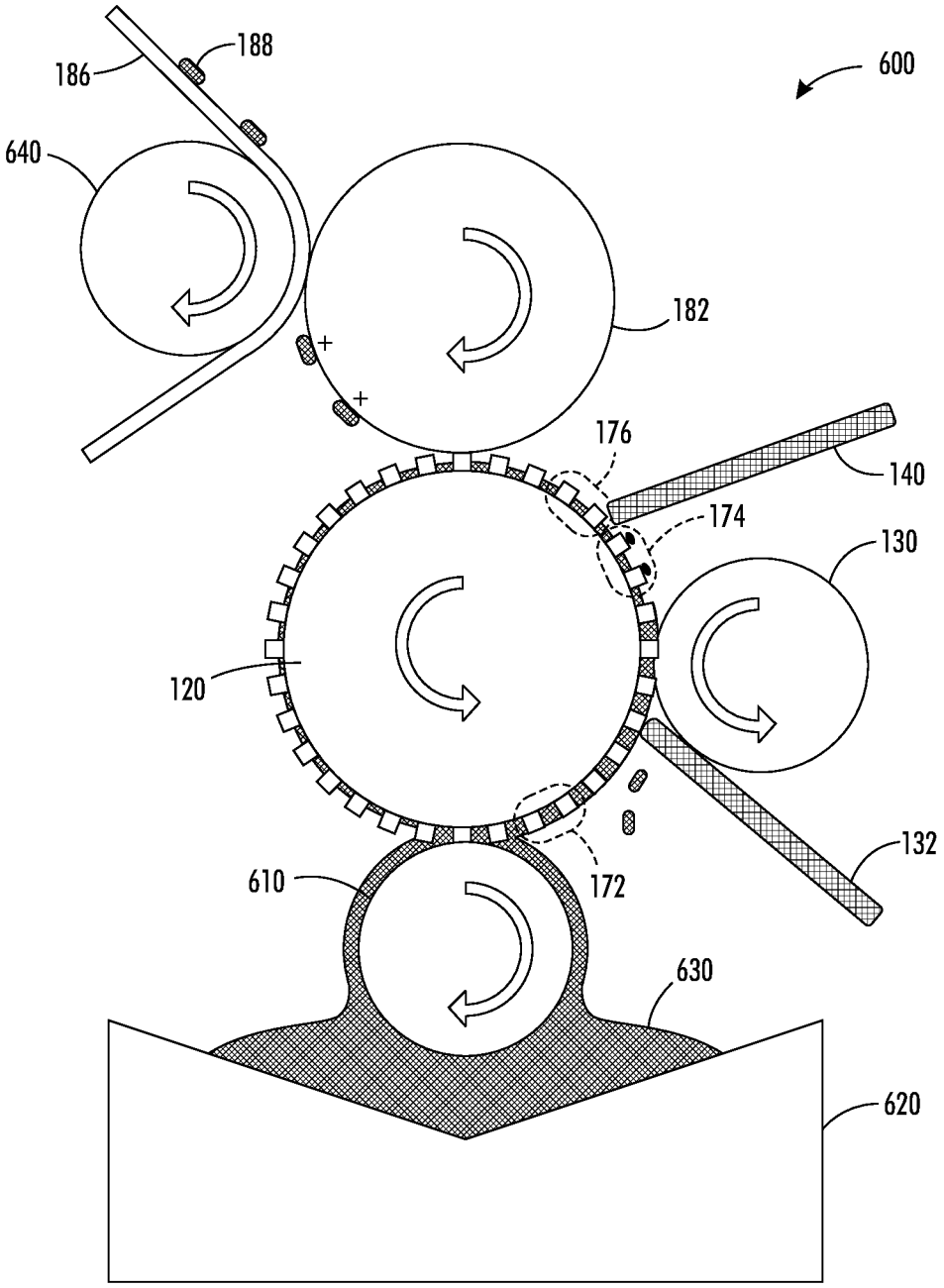
FIG. 6 is a diagram illustrating a system with the blanket roller rotating in reverse direction of the direction shown in FIG. 1 according to one embodiment.

The anilox roller 120 may be a conventional anilox roller which has a gravure with a plurality of valleys or grooves such as valley 124 and lands such as land 126. The valleys 124 and the lands 126 form the cells 122. The valley 124 is used to contain ink 114 obtained from an ink supply 112. The filling of the cells 122 with the ink 114 may be done with conventional techniques such as a chamber blade system as shown in FIG. 1, or a pickup roller in a pan as shown in FIG. 6. A conventional stiff containment blade 118 may be used to leave the cells 122 full or nearly full (e.g., 90% of the volume provided by the valley 124). An example of a full or nearly full cell 122 is a full cell 172. The doctor blade 116 may be used to clean the lands 126 or to wipe off any ink residue as in the conventional system. The anilox roller 120 may rotate or move circularly in a first direction (e.g., counterclockwise as shown in FIG. 1).

The blanket roller 130 is rotationally engaged with the anilox roller 120 to withdraw, extract, or pull the ink out of the cells 122 causing the valleys 124 to be partially filled. The ink in the fully or nearly full cells 122 adheres to the surface of the blanket roller 130. As the blanket roller 130 rotates, the adhered ink may be pulled out reducing the ink amount in the full or nearly full cells 122. The ink volume or the depth in the valleys 124 may be reduced approximately by half of the original fill level. An example of a half full or nearly half full cell 122 may be a half full or nearly half full cell 174. The half full or nearly half full cell 174 may contain ink residue or satellites that form on the lands of the cell 172. The blanket roller 130 rotates in a second direction. The second direction may be the same as the first direction of the anilox roller 120, or the reverse or opposite direction of the anilox roller 120 (e.g., clockwise as shown in FIG. 1). The ink withdrawn, extracted or pulled by the blanket roller 130 may be collected into a container 134 by a blanket roller blade 132. The collected ink in the container 134 may be recycled to be re-used as the ink for the ink supply 112.

The blanket roller 130 may need to be cleaned so that a fresh surface may be used to meter and pull out ink. A blanket roller cleaner 150 may be used to clean the ink off the blanket roller 130 and recycle the ink into the ink supply 112.

The cleaning blade 140 cleans tops of the lands 126 of the cells 122 to remove any ink residue remaining on tops of the lands 126. The cleaning blade 140 may be positioned subsequent to the action of the blanket roller 130 in either doctor or wiping mode. After the cleaning, the cell 174 may become cleaned as a cleaned half full cell 176. The cleaning done by the cleaning blade 140 may use a standard blading mode. Achieving the mechanical response of the blade for high speed may be now easier as the blade does not have to be soft to penetrate into the cells 122 (e.g., into the valleys 124). Accordingly, this technique reduces the burden on the metering blade to enable a more reliable metering system than the conventional system. The satellites may also be cleaned by another means such as another roller.

The image forming unit 180 may be coupled to the ink loading mechanism 110 to form an image 188 using the ink from the cleaned cells 176. The image forming unit 180 may include a photoreceptor drum or belt 182 having a photoreceptor rotationally engaged with the anilox roller 120, a charge image generator 184 coupled to the photoreceptor drum or belt 182 to image-wise charge the photoreceptor, and a substrate 186 in contact or nearly in contact (in proximity) with the photoreceptor drum or belt 182 to receive the image as the photoreceptor drum or belt 182 rotates. The charge image generator 184 may be made by any of known methods to generate a charge image, including a blanket charging with scorotron followed by an image-wise discharging scanning laser or light emitting diode bar array, or a direct write system such as an addressable array of small charge emitters (e.g., iconography).

The amount of ink to be pulled out from the full or nearly full cells 172 may be controlled, tuned, or varied to provide a desired performance. There may be a number of techniques to do this. In the first technique, a speed controller 160 coupled to the blanket roller 130 is used to adjust speed of rotation of the blanket roller 130. In the second technique, an electric field generator 190 may be used to apply an electric field 192 across the gap or depth between the lowest points of the ink meniscus in the valley 124 and the land 126 of the cell 122 during the transfer of the ink from the full or nearly full cell 172 to the blanket roller 130. This may be implemented through an electrical bias applied between the blanket roller 130 and the anilox roller 120. In the third technique, the direction of movement or rotation of the blanket roller 130 may be changed to be the same or in reverse direction with that of the anilox roller 120. This may be illustrated in FIG. 6. These techniques may be optional. They may not be used at all. They may also be used individually or in combination.

Figure 2:
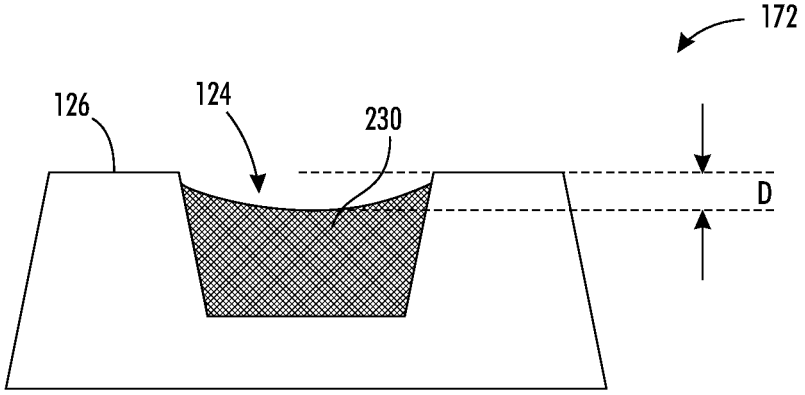
FIG. 2 is a diagram illustrating a full or near full cell according to one embodiment.

FIG. 2 is a diagram illustrating the full or near full cell 172 according to one embodiment. The full or nearly full cell 172 contains the ink 230 filled in the valley 124 at or close to the surface of the land 126. Let D be the gap or depth between the lowest points of the ink meniscus in the valley 124 and the land 126. For a full or nearly full ink filling, D may be less than 10% of the depth of the valley 124. In one embodiment, a full or nearly full cell may correspond to the ink occupying at least 85% of the volume in the valley of the cell. The depth of the valley 124 may be defined as the distance from the bottom of the valley 124 to the level surface of the land 126. The valley depth varies depending on the type of gravure. In one embodiment, the valley depth may range from 5 μm to 60 μm.

Figure 3:
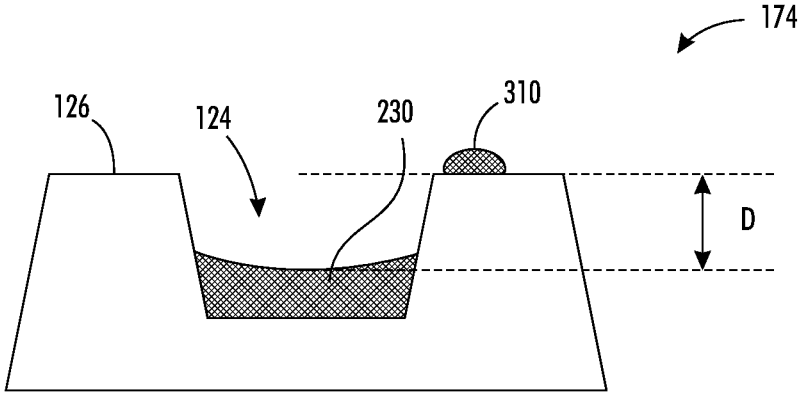
FIG. 3 is a diagram illustrating a partially full cell with ink residues on lands according to one embodiment.

FIG. 3 is a diagram illustrating the partially full or nearly half full cell 174 with ink residues on lands according to one embodiment. The half full or nearly half full cell 174 may be obtained after the ink pulling action of the blanket roller 130. During this action, a portion of the ink in the valley 124 is transferred to the surface of the blanket roller 130 such that the amount of ink in the valley 124 is reduced by approximately half. In other words, the distance D between lowest point of the ink meniscus in the valley 124 and the land 126 in the partially filled, or half full or nearly half full, cell 174 increases (the depth reduces), so the volume of ink in the cell is reduced by approximately half from the valley depth. The phrase "approximately half" may correspond to a percentage of 30% to 60%. The dimension that the ink is reduced may be the depth dimension or the volume dimension. In one embodiment, a half full or nearly half full cell may correspond to the ink occupying approximately between 30% to 60% of the volume in the valley of the cell. The transfer of the ink during this phase may leave satellites or ink residue 310 on the surface of the land 126.

Figure 4:
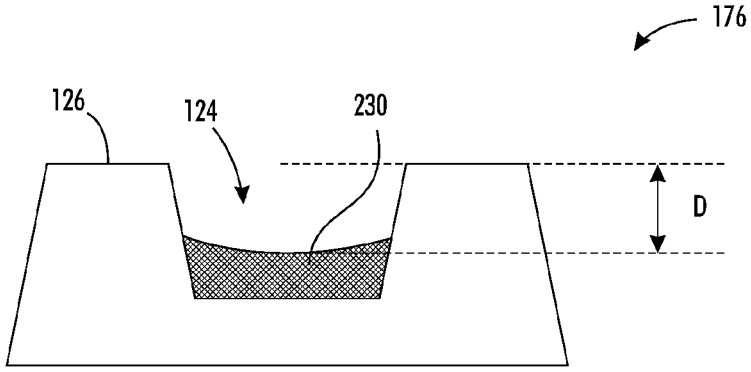
FIG. 4 is a diagram illustrating a partially full cell after cleaning according to one embodiment.

FIG. 4 is a diagram illustrating a partially full or nearly half full cell 176 after cleaning according to one embodiment. After the ink pulling action by the blanket roller 130, the cleaning action done by the cleaning blade 140 may remove or wipe off the ink residue 310 on the land 126 leaving a cleaned cell. The advantage of having this land cleaning step is that there is no ink residue on the lands to transfer and cause unwanted background printing.

Figure 5:
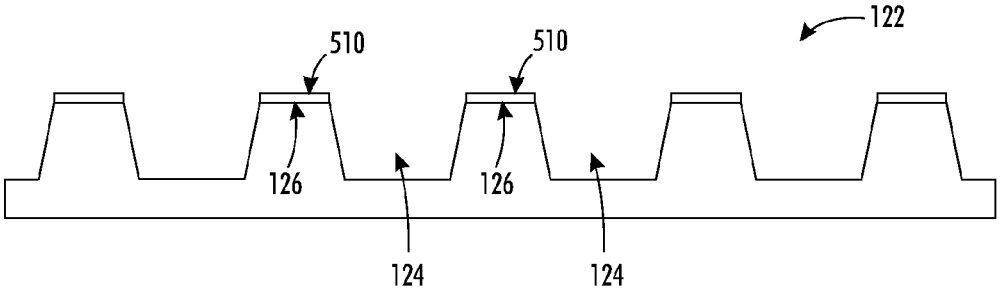
FIG. 5 is a diagram illustrating low energy surface coating on the lands according to one embodiment.

FIG. 5 is a diagram illustrating low energy surface coating on the lands according to one embodiment.

To prevent or reduce the amount of ink residue or satellite ink formations on the land 126, the surface or the top of the land 126 may be coated with a low energy surface coating 510. The low energy surface coating 510 may have any one of the following characteristics: covalently bonded monolayer, low surface energy, and thermally and mechanically stable.

FIG. 6 is a diagram illustrating a system 600 with the blanket roller rotating in reverse direction of the direction shown in FIG. 1 according to one embodiment. The system 600 illustrates the technique to rotate the blanket roller 130 in a reverse direction of the direction shown in FIG. 1. In this exemplary embodiment, the anilox roller 120 and the blanket roller 130 rotates in the same direction. The system 600 is similar to the system 100. It includes the anilox roller 120, the blanket roller 130, the photoreceptor drum or belt 182, the substrate 186, the compression roller 640, the cleaning blade 140, and the blanket roller blade 132, a fountain roller 610, an ink container or supply 620 and the ink 630. The anilox roller 120, the blanket roller 130, the photoreceptor drum 182, the substrate 186, the cleaning blade 140, and the blanket roller blade 132 are similar to the components with the same names and labels as shown in FIG. 1. For simplicity and clarity, not all components of the system are shown. It is also noted that the system 600 may include more or less than the above components.

The fountain roller 610 applies the ink 630 from the ink container or supply 620 to fill the cells in the anilox roller 120. The full or nearly full cells are represented by the cell 172. The blanket roller 130 is rotationally engaged with the anilox roller 120 in the same rotational direction to pull the ink from the full or nearly full cells. The blanket roller blade 132 removes the ink from the blanket roller 130 so that the ink may be recycled into the ink container 620. After the action of the blanket roller 130, the cells become half full or nearly half full as represented by the cell 174. The cleaning blade 140 cleans the ink residue on the lands of the cells and provides the cleaned half full or nearly half full cells as represented by the cleaned half full or nearly half full cell 176. In one embodiment, more than one cleaning blade 140 may be used to aid in the metering. The photoreceptor drum 182 transfers the ink via an image pattern writing procedure to form the image 188 on the surface of the substrate 186.

Figure 7:
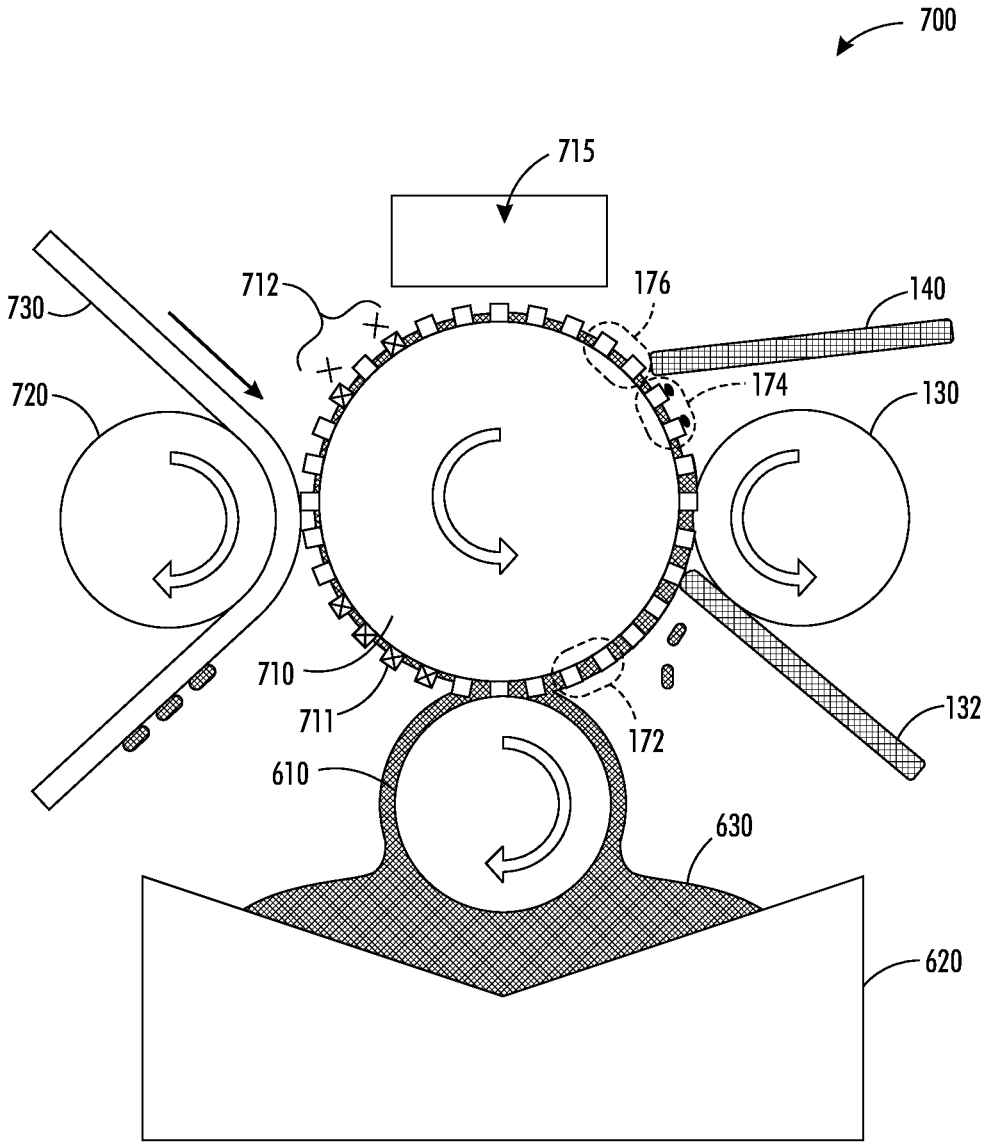
FIG. 7 is a diagram illustrating a system with an integrated photoreceptor and gravure according to one embodiment.

FIG. 7 is a diagram illustrating a system 700 with an integrated photoreceptor and gravure according to one embodiment. The system 700 is similar to the system 600 and includes the same components with the same labeled references as in the system 600. In addition, the system 700 includes an integrated roller 710, a charge pattern generator 715, a bias roller 720 and a substrate 730.

The integrated roller 710 includes a gravure with an integrated photoreceptor. In the roller 710, the gravure, which has cells or grooves for holding the ink, has an integrated photoreceptor as part of its land structure 711. The photoreceptor holds a charge pattern which modulates the ink meniscus image-wise so that only ink in cells near charge are developed onto a final substrate with a charge image 712. The substrate 730 may be electrically biased with the bias roller 720 to aid image development. One advantage of this system is that no separate photoreceptor cleaning system is needed and the metering system serves the same function as in the system 600. In addition, there is only one ink transfer, so more ink may be delivered to the substrate 730.

Figure 8:
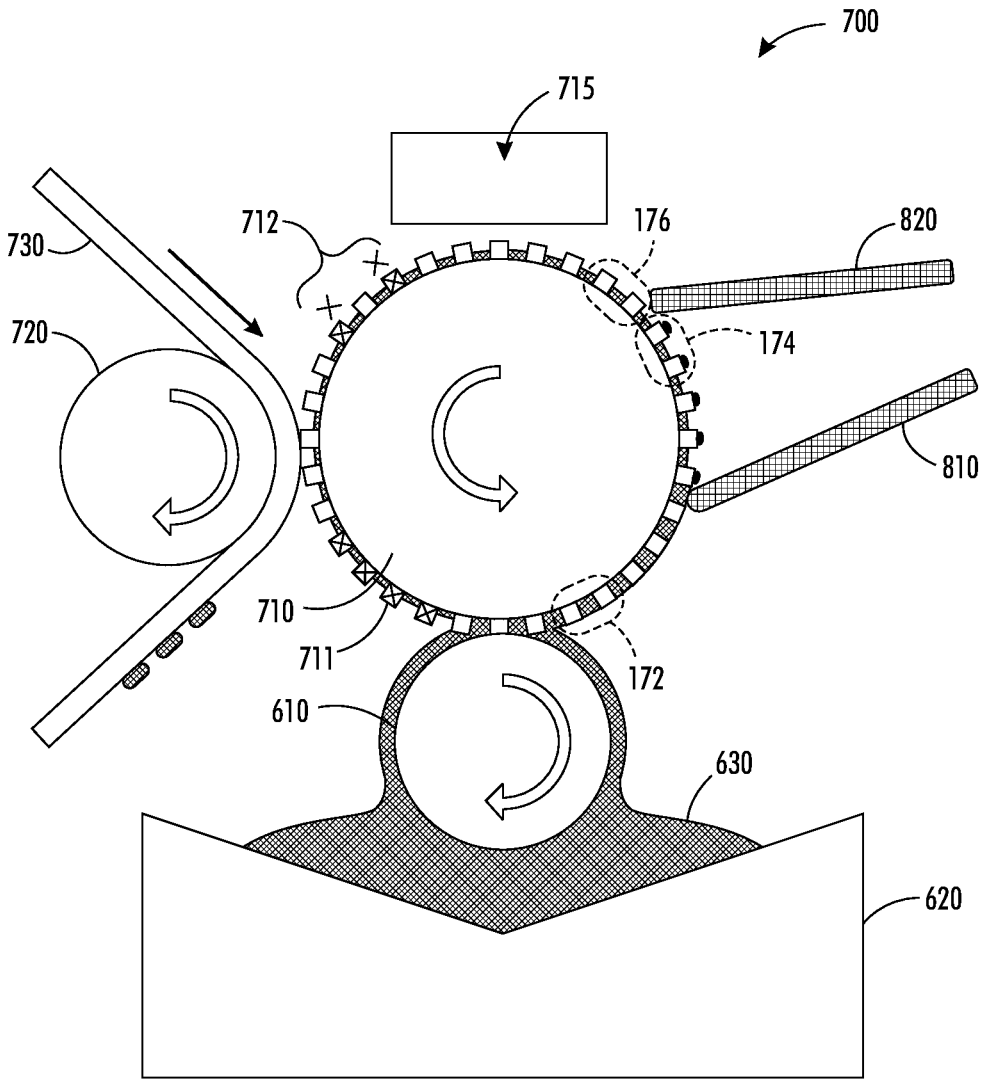
FIG. 8 is a diagram illustrating a system using double blades according to one embodiment.

FIG. 8 is a diagram illustrating a system 800 using double blades according to one embodiment. The system 800 is similar to the systems 100, 600 and 700 shown in FIGS. 1, 6 and 7, respectively, except that it does not use the blanket roller 130 to pull the ink. Instead, a double-blade configuration is used. In a double blade system, a soft blade 810 and a hard blade 820 may be used. The soft blade 810 is used in a doctoring mode to push out the ink as the anilox roller 710 rotates and the hard blade 820 is used in a cleaning mode to clean any residues or satellites on the lands of the cells as the anilox roller 710 rotates. The hard blade 820 may be placed behind the soft blade 810 in the direction of the rotation of the anilox roller 710. The soft blade may be in doctor or wiping mode. In addition, multiple blades may be used.

Figure 9:
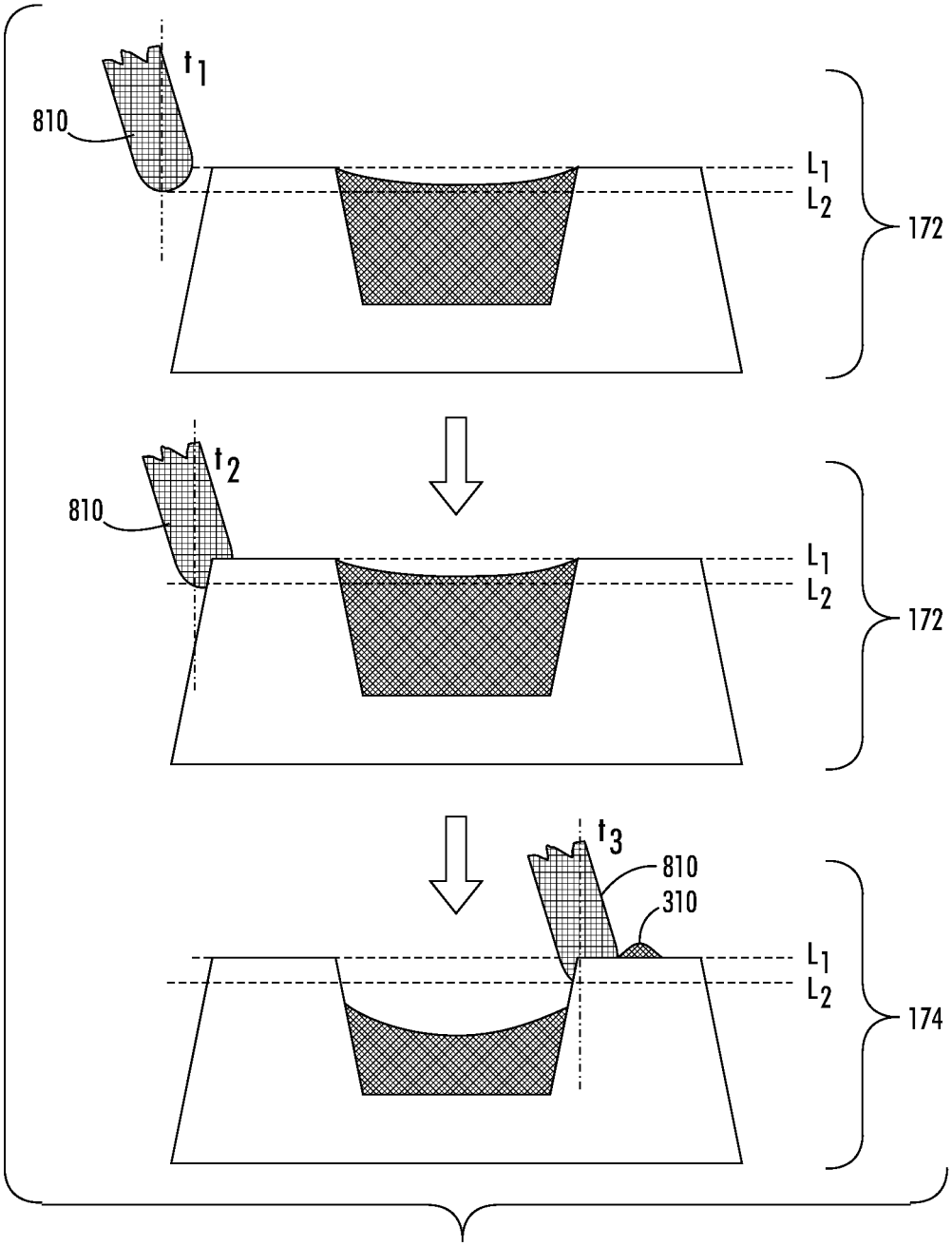
FIG. 9 is a diagram illustrating a soft blade in a doctoring mode according to one embodiment.

FIG. 9 is a diagram illustrating a soft blade in a doctoring mode according to one embodiment. The soft blade 810 may be used to remove part of the ink from the cells. The soft blade 810 may be positioned at a level L2 which is slightly below the level L1 of the land surface to remove ink from the cells and causes the valleys to be partially filled. The level L2 may be such that the soft blade 810 is able to remove the ink at a predetermined amount. For example, it may be at about 70% to 95% of the height of the land.

At time $t_1$, the soft blade 810 is about to touch the land to move toward the ink. At time $t_2$, the soft blade 810 touches the land. Since it is soft, it is compressed as it moves through the land toward the ink. At time $t_3$, the soft blade 810 expands below the level L1, sweeps through the ink, and wipes out some ink, leaving the cell partially full. Since the soft blade 810 has a limited maximum pressure that it can apply, it may leave some residue or satellites 310 on the surface of the land. The residue or satellite 310 may be cleaned by the hard blade 820 in a cleaning mode.

Figure 10:
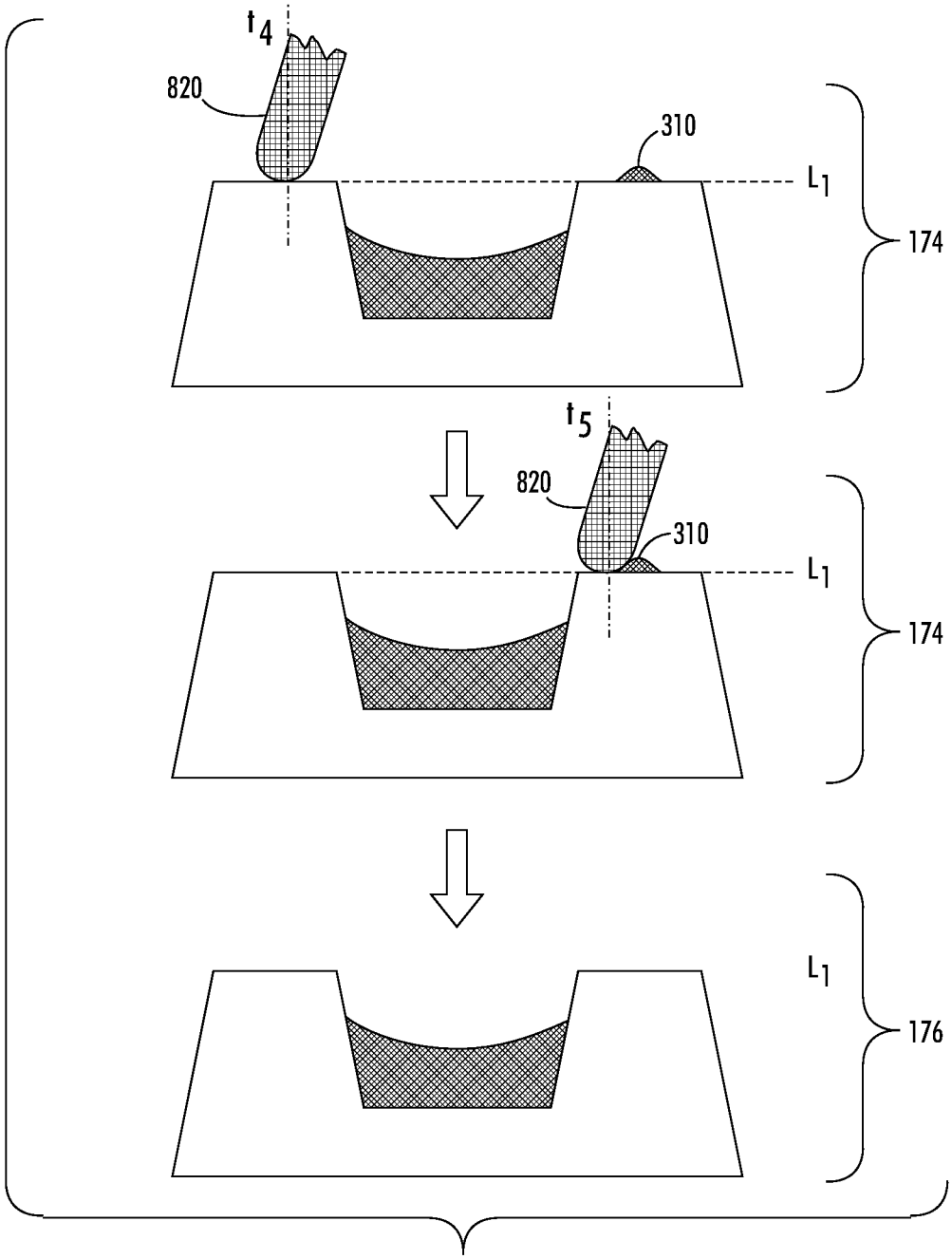
FIG. 10 is a diagram illustrating a hard blade in a cleaning mode according to one embodiment.

FIG. 10 is a diagram illustrating a hard blade in a cleaning mode according to one embodiment. The hard blade 820 does not deform its shape as much as the soft blade 810. It may provide higher pressure and does a better job in wiping the lands clean. The hard blade 820 may be positioned at or near the level L1 of the land surface.

At time $t_4$, the hard blade 820 is at the level L1 of the land surface. As it moves through the land surface, it does not significantly penetrate into the cells. At time $t_5$, it moves to the land surface and wipes out the residue or satellites 310 resulting in a cleaned land surface 176.

Figure 11:
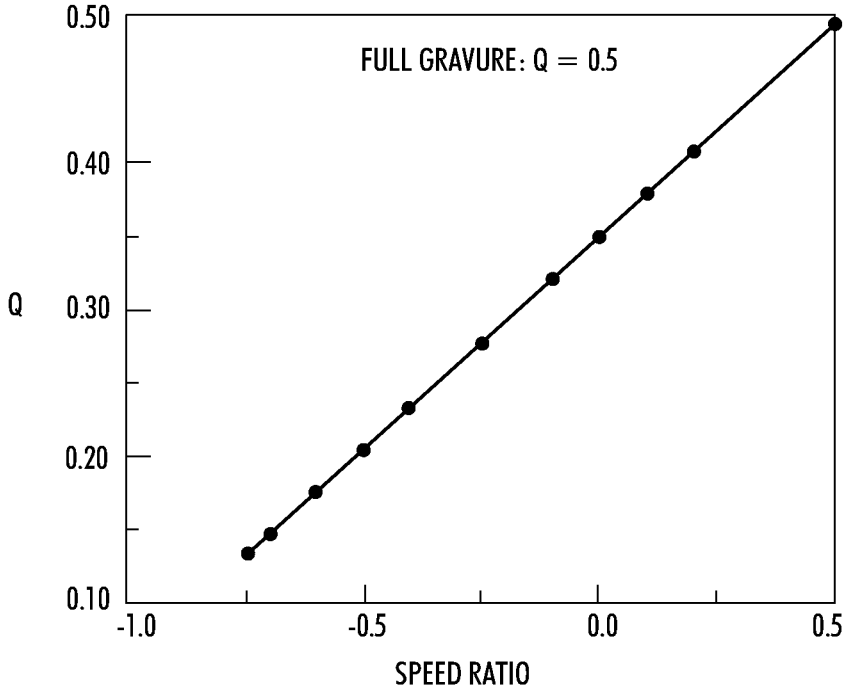
FIG. 11 is a diagram illustrating a flow volume as a function of speed ratio according to one embodiment.

FIG. 11 is a diagram illustrating a flow volume as a function of speed ratio according to one embodiment.

The graph represents a simulation of the flow volume as a function of the speed ratio based on film rupture models by Coyne and Elrod. The speed ratio is the ratio between the speed of the web and the speed of the roll. The positive values of the speed ratio represent the forward metering while the negative values represent the reverse metering. The graph shows a linear relationship between the flow volume and the speed ratio. In addition, the direction of the rotation may have effect on the flow volume.

Figure 12:
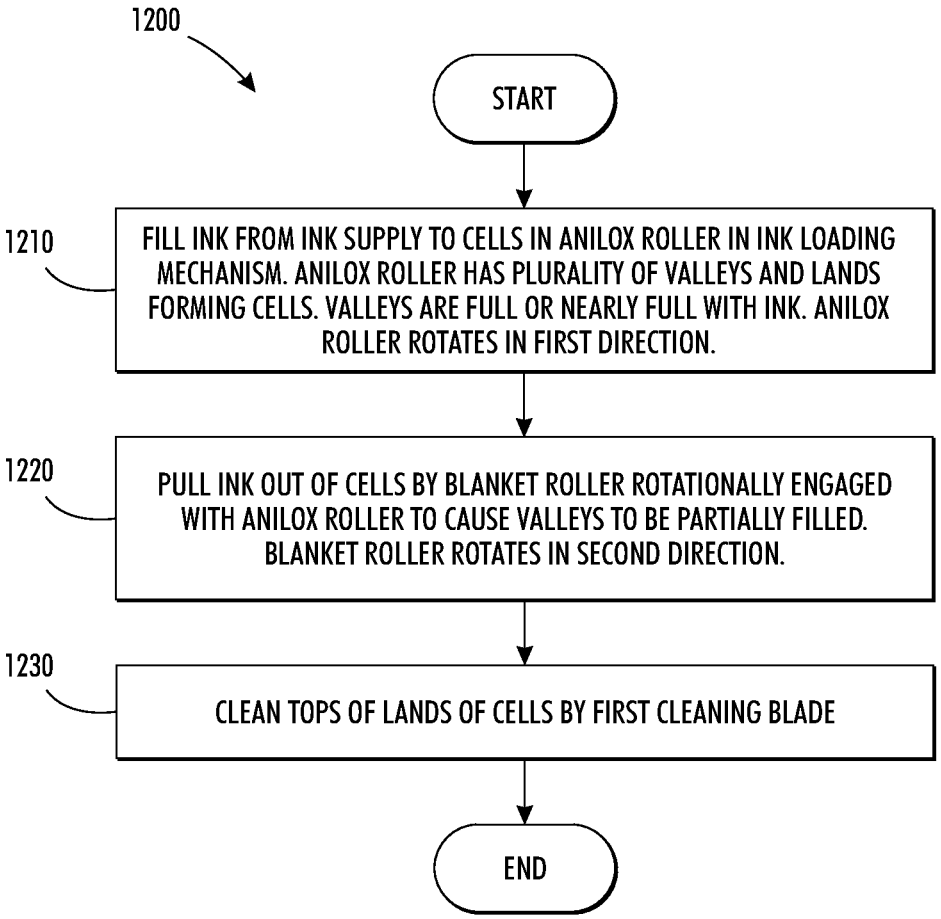
FIG. 12 is a flowchart illustrating a process to meter ink using a blanket roller according to one embodiment.

FIG. 12 is a flowchart illustrating a process 1200 to meter ink using a blanket roller according to one embodiment.

Upon START, the process 1200 fills ink from an ink supply to cells in an anilox roller in an ink loading mechanism (Block 1210). The anilox roller has a plurality of valleys and lands forming the cells. The valleys are full or nearly full with the ink. The anilox roller rotates in a first direction.

Next, the process 1200 pulls the ink out of the cells by a blanket roller rotationally engaged with the anilox roller to cause the valleys to be partially filled (Block 1220). The blanket roller rotates in a second direction. The second direction may be the same or different direction as the first direction.

Then, the process 1200 cleans tops of the lands of the cells by a first cleaning blade (Block 1230). The process 1200 is then terminated. The process 1200 may have additional operations as described above. For example, these operations may include cleaning the ink off the blanket roller by a blanket roller cleaner, recycling the ink into the ink supply, forming an image using the ink from the cells by an image forming unit (e.g., charging photoreceptor that may be located within a photoreceptor drum or belt or integrated into the lands, receiving the image on a substrate), adjusting speed of rotation of the blanket roller, cleaning tops of the lands by a second cleaning blade, and generating an electric field across gaps of the cells.

Figure 13:
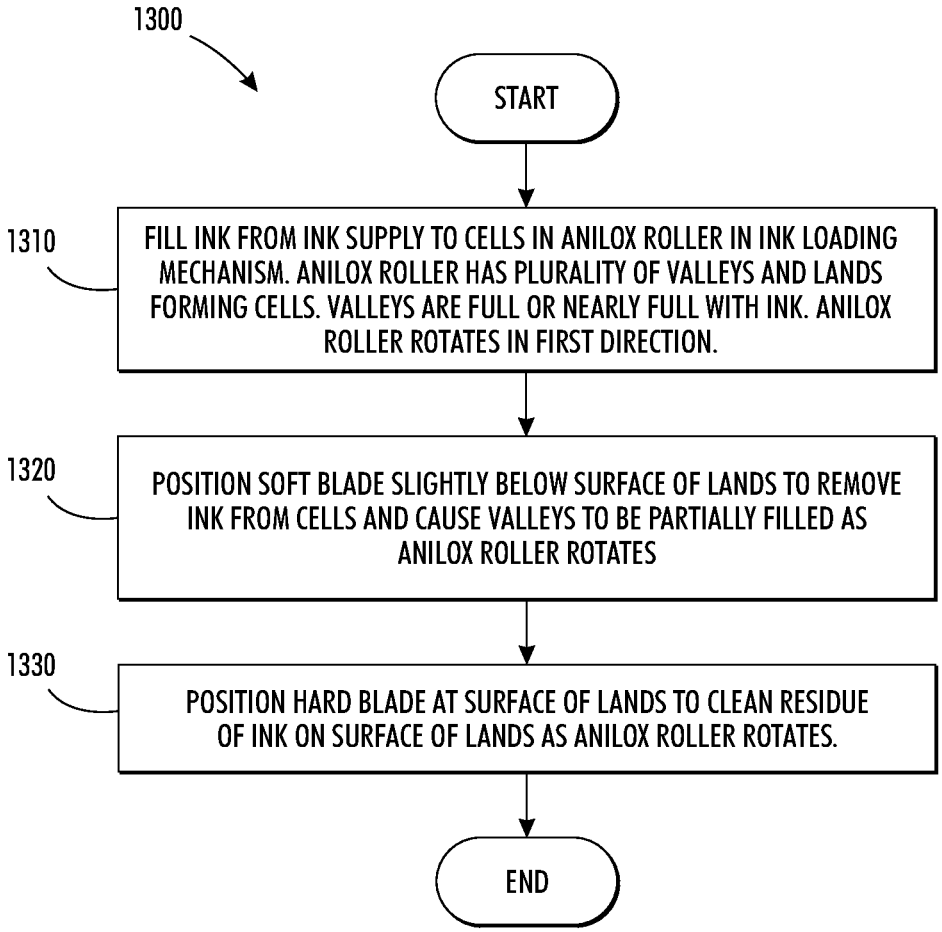
FIG. 13 is a flowchart illustrating a process to meter ink using double blades according to one embodiment.

FIG. 13 is a flowchart illustrating a process 1300 to meter ink using double blades according to one embodiment.

Upon START, the process 1300 fills ink from an ink supply to cells in an anilox roller in an ink loading mechanism (Block 1310). The anilox roller has a plurality of valleys and lands forming the cells. The valleys are full or nearly full with the ink. The anilox roller rotates in a first direction.

Next, the process 1300 positions a soft blade slightly below surface of the lands to remove the ink from the cells and cause the valleys to be partially filled as the anilox roller rotates (Block 1320). The positioning of the soft blade is at a distance below the surface of the lands sufficient for the removal of the ink so that the valleys are partially filled.

Then, the process 1300 positions a hard blade at the surface of the lands to clean any residue of ink oft on the surface of the lands as the anilox roller rotates (Block 1330). The process 1300 is then terminated. The process 1300 may have additional operations as described above. For example, these operations may include recycling the ink into the ink supply, forming an image using the ink from the cells by an image forming unit (e.g., charging photoreceptor that may be integrated into the lands, receiving the image on a substrate), etc.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus comprising:

an ink loading mechanism having an anilox roller to fill ink from an ink supply into cells in the anilox roller having a plurality of valleys and lands forming the cells, the ink loading mechanism causing the valleys to be full or nearly full with the ink, the anilox roller rotating in a first direction;

a first blade positioned slightly below surface of the lands to remove ink from the cells and cause the valleys to be partially filled as the anilox roller rotates; and a second blade positioned at the surface of the lands to clean residue of ink on the surface of the lands as the anilox roller rotates, wherein the first and second blades are separate and different, and wherein the second blade does not deform its shape as much as the first blade.

2. The apparatus of claim 1 wherein the anilox roller includes photoreceptors integrated into the lands.

3. The apparatus of claim 2 further comprising:

an image forming unit coupled to the ink loading mechanism to form an image using the ink from the cells, the image forming unit comprising:

a charge image generator coupled to the photoreceptors to charge the photoreceptors; and a substrate in proximity with the anilox roller to receive the image as the anilox roller rotates.

4. The apparatus of claim 1 wherein tops of the lands are coated with low energy surface coating.

5. The apparatus of claim 1 further comprising:

an electric field generator to generate an electric field across gaps of the cells.

6. The apparatus of claim 1 wherein depths between lowest points of the ink meniscus in the valleys and the lands in the partially filled valleys reduce by approximately half from a valley depth.

7. A method comprising:

filling ink from an ink supply to cells in an anilox roller in an ink loading mechanism, the anilox roller having a plurality of valleys and lands forming the cells, the valleys being full or nearly full with the ink, the anilox roller rotating in a first direction;

positioning a first blade slightly below surface of the lands to remove ink from the cells and cause the valleys to be partially filled as the anilox roller rotates; and positioning a second blade at the surface of the lands to clean residue of ink on the surface of the lands as the anilox roller rotates, wherein the first and second blades are separate and different, and wherein the second blade does not deform its shape as much as the first blade.

8. The method of claim 7 wherein the anilox roller includes photoreceptors integrated into the lands.

9. The method of claim 8 further comprising:

forming an image using the ink from the cells by an image forming unit, forming the image comprising:

charging the photoreceptors; and receiving the image as the anilox roller rotates on a substrate in proximity with the anilox roller.

10. The method of claim 7 wherein tops of the lands are coated with low energy surface coating.

11. The method of claim 7 further comprising:

generating an electric field across gaps of the cells.

12. The method of claim 7 wherein depths between lowest points of the ink meniscus in the valleys and the lands in the partially filled valleys reduce by approximately half from a valley depth.

13. A system comprising:

an ink supply to provide ink;

a metering unit coupled to the ink supply, the metering unit comprising:

an ink loading mechanism having an anilox roller to fill the ink from the ink supply into cells in the anilox roller having a plurality of valleys and lands forming the cells, the ink loading mechanism causing the valleys to be full or nearly full with the ink, the anilox roller rotating in a first direction, a first blade positioned slightly below surface of the lands to remove ink from the cells and cause the valleys to be partially filled as the anilox roller rotates, and a second blade positioned at the surface of the lands to clean residue of ink on the surface of the lands as the anilox roller rotates, wherein the first and second blades are separate and different, and wherein the second blade does not deform its shape as much as the first blade; and an image forming unit coupled to the ink loading mechanism to form an image using the ink from the cells.

14. The system of claim 13 wherein the anilox roller includes photoreceptors integrated into the lands.

15. The system of claim 14 wherein the image forming unit comprises:

a charge image generator coupled to the photoreceptors to charge the photoreceptors; and a substrate in proximity with the anilox roller to receive the image as the anilox roller rotates.

16. The system of claim 13 wherein tops of the lands are coated with low energy surface coating.

17. The system of claim 13 wherein the metering unit further comprises:

an electric field generator to generate an electric field across gaps of the cells.

18. The system of claim 13 wherein depths between lowest points of the ink meniscus in the valleys and the lands in the partially filled valleys reduce by approximately half from a valley depth.

* * * * *